US012000255B1

(12) United States Patent
Damm et al.

(10) Patent No.: US 12,000,255 B1
(45) Date of Patent: Jun. 4, 2024

(54) OPERATION OF A RECIRCULATION CIRCUIT FOR A FLUID PUMP OF A HYDRAULIC FRACTURING SYSTEM

(71) Applicant: Caterpillar Inc., Peoria, IL (US)

(72) Inventors: Shawn M. Damm, Houston, TX (US); Yuesheng He, Sugar Land, TX (US); Sri Harsha Uddanda, Cypress, TX (US); Todd Ryan Kabrich, Tomball, TX (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/168,248

(22) Filed: Feb. 13, 2023

(51) Int. Cl.
*E21B 43/26* (2006.01)
*E21B 34/02* (2006.01)

(52) U.S. Cl.
CPC ..... *E21B 43/2607* (2020.05); *E21B 34/025* (2020.05)

(58) Field of Classification Search
CPC ..... E21B 43/2507; E21B 34/025
See application file for complete search history.

(56) References Cited

U.S. PATENT DOCUMENTS 3,443,643 A * 5/1969 Jones ..... E21B 21/08 175/218
7,574,896 B1 8/2009 Cooper
9,133,690 B1 * 9/2015 Tanju ..... E21B 43/128
9,702,372 B2 * 7/2017 Leininger ..... F04D 29/2283
11,066,813 B2 7/2021 Poojary et al.
11,634,971 B1 * 4/2023 AlSayed ..... E21B 34/025 166/250.01
2022/0213781 A1 * 7/2022 Parthasarathy ..... F04D 15/0088

FOREIGN PATENT DOCUMENTS

JP 2002340300 A 11/2002
JP 2021195778 A 12/2021
KR 100514838 B1 9/2005

* cited by examiner

*Primary Examiner* — James G Sayre

(57) ABSTRACT

A control system may include a fluid conduit configured to direct fluid discharged from a fluid pump. The control system may include a shutoff valve and a throttling valve in the fluid conduit. The control system may include a controller configured to cause, while the shutoff valve is closed, actuation of the throttling valve to an open position. The controller may be configured to obtain first information indicating a first pressure of the fluid in the fluid conduit at a first side of the throttling valve between the throttling valve and the shutoff valve and second information indicating a second pressure of the fluid in the fluid conduit at a second side of the throttling valve. The controller may be configured to transmit a signal to indicate that the shutoff valve has a leak based on the first pressure being different from the second pressure.

20 Claims, 5 Drawing Sheets

OPERATION OF A RECIRCULATION CIRCUIT FOR A FLUID PUMP OF A HYDRAULIC FRACTURING SYSTEM

TECHNICAL FIELD

The present disclosure relates generally to fluid pumps and, for example, to operation of a recirculation circuit for a fluid pump of a hydraulic fracturing system.

BACKGROUND

A fluid system may utilize multiple valves for flow control. For example, a fluid system may include a throttling valve for modulating fluid flow and a shutoff valve for halting fluid flow. In some cases, the shutoff valve may be defective or may develop a leak over time (e.g., due to abrasive wear from the fluid). If undetected, a leak in the shutoff valve may eventually result in catastrophic failure of the shutoff valve and cause damage to downstream equipment.

A hydraulic fracturing system is an example of a fluid system that utilizes valves for flow control. Hydraulic fracturing is a well stimulation technique that typically involves pumping hydraulic fracturing fluid into a wellbore at a rate and a pressure (e.g., up to 15,000 pounds per square inch (psi)) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

The control system of the present disclosure solves one or more of the problems set forth above and/or other problems in the art.

SUMMARY

A control system may include a recirculation circuit configured to direct fluid from an outlet of a fluid pump of a hydraulic fracturing system, via a first portion of the recirculation circuit, to an inlet of the fluid pump via a second portion of the recirculation circuit. The control system may include a control valve in the recirculation circuit between the first portion of the recirculation circuit and the second portion of the recirculation circuit. The control system may include a choke valve in the recirculation circuit between the first portion of the recirculation circuit and the second portion of the recirculation circuit. The control system may include a controller configured to cause, while the control valve is closed, actuation of the choke valve to a partially open position. The controller may be configured to obtain first information indicating a first pressure of the fluid at a first side of the choke valve between the choke valve and the control valve and second information indicating a second pressure of the fluid at a second side of the choke valve. The controller may be configured to transmit a signal to indicate that the control valve has a leak based on the first pressure being different from the second pressure.

A control system may include a fluid conduit configured to direct fluid discharged from a fluid pump. The control system may include a shutoff valve in the fluid conduit. The control system may include a throttling valve in the fluid conduit. The control system may include a controller configured to cause, while the shutoff valve is closed, actuation of the throttling valve to an open position. The control system may include a controller configured to obtain first information indicating a first pressure of the fluid in the fluid conduit at a first side of the throttling valve between the throttling valve and the shutoff valve and second information indicating a second pressure of the fluid in the fluid conduit at a second side of the throttling valve. The controller may be configured to transmit a signal to indicate that the shutoff valve has a leak based on the first pressure being different from the second pressure.

A method may include causing, by a controller, closing of a shutoff valve in a fluid conduit configured to direct fluid discharged from a fluid pump. The method may include causing, by the controller, actuation of a throttling valve in the fluid conduit to a partially open position. The method may include obtaining, by the controller, first information indicating a first pressure of the fluid in the fluid conduit at a first side of the throttling valve between the throttling valve and the shutoff valve and second information indicating a second pressure of the fluid in the fluid conduit at a second side of the throttling valve. The method may include determining, by the controller, whether the first pressure is different from the second pressure, where the first pressure being different from the second pressure is indicative of a leak in the shutoff valve. The method may include performing one or more actions based on a determination that the first pressure is different from the second pressure.

DETAILED DESCRIPTION

Figure 1:
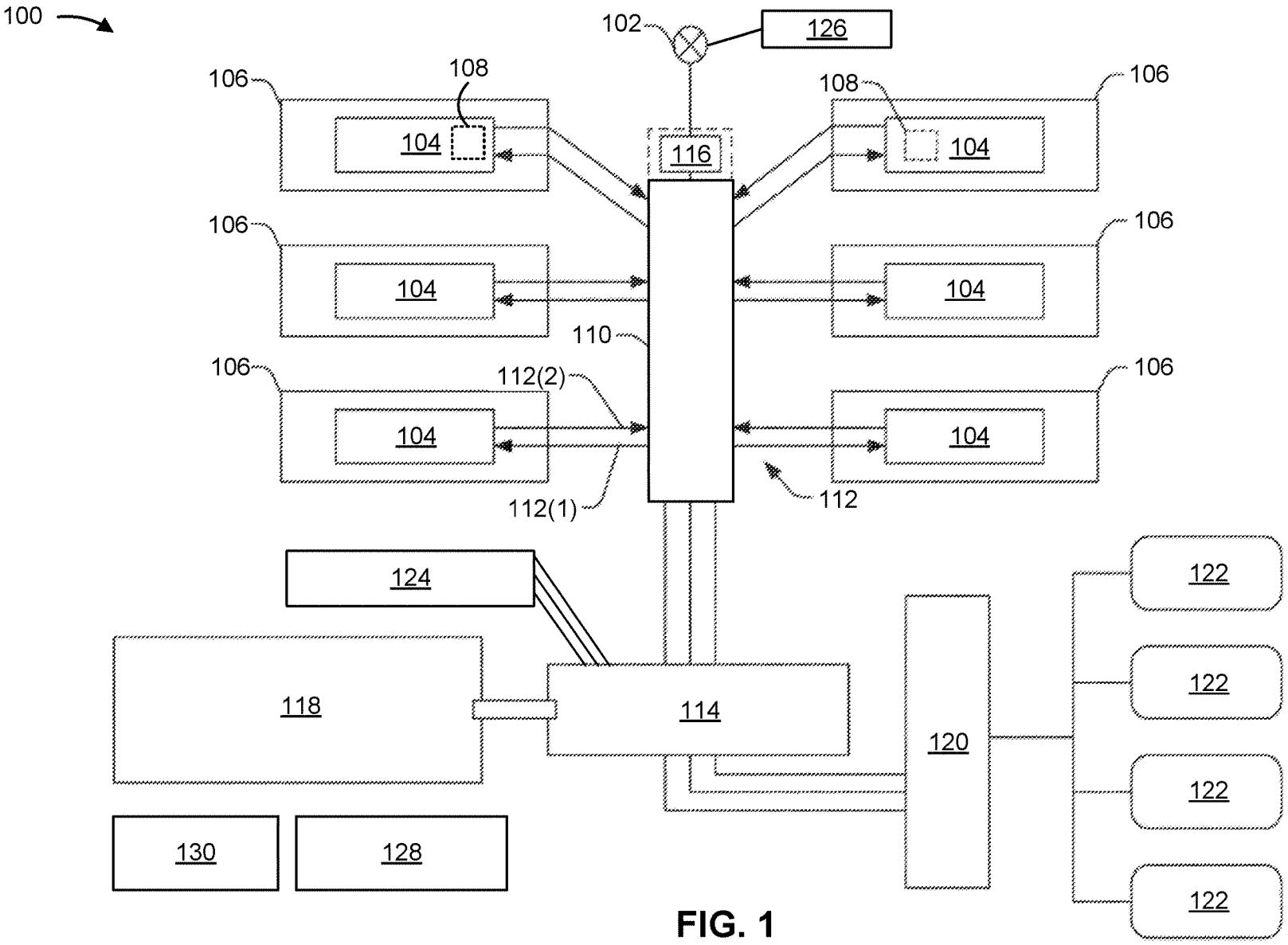
FIG. 1 is a diagram illustrating an example hydraulic fracturing system.

FIG. 1 is a diagram illustrating an example hydraulic fracturing system 100. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. Hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). Each of the pump systems 104 may also include at least one prime mover for a fluid pump 108, such as an engine or a motor, which may share a housing with the fluid pump 108. The fluid pumps 108 may be hydraulic fracturing pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, the pressure necessary to complete the hydraulic fracture, or the like. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. For example, each fluid pump 108 may be configured to discharge fluid to the manifold 110. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other types of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 may be a system-wide controller for the hydraulic fracturing system 100 or a pump-specific controller for a pump system 104. The controller 130 may be communicatively coupled (e.g., by a wired connection or a wireless connection) with one or more of the pump systems 104. The controller 130 may also be communicatively coupled with other equipment and/or systems of the hydraulic fracturing system 100. The controller 130 may include one or more memories and/or one or more processors. In some implementations, the controller 130 may be or may include a proportional-integral-derivative (PID) controller.

As indicated above, FIG. 1 is provided as an example. Other examples may differ from what is described with regard to FIG. 1.

Figure 2:
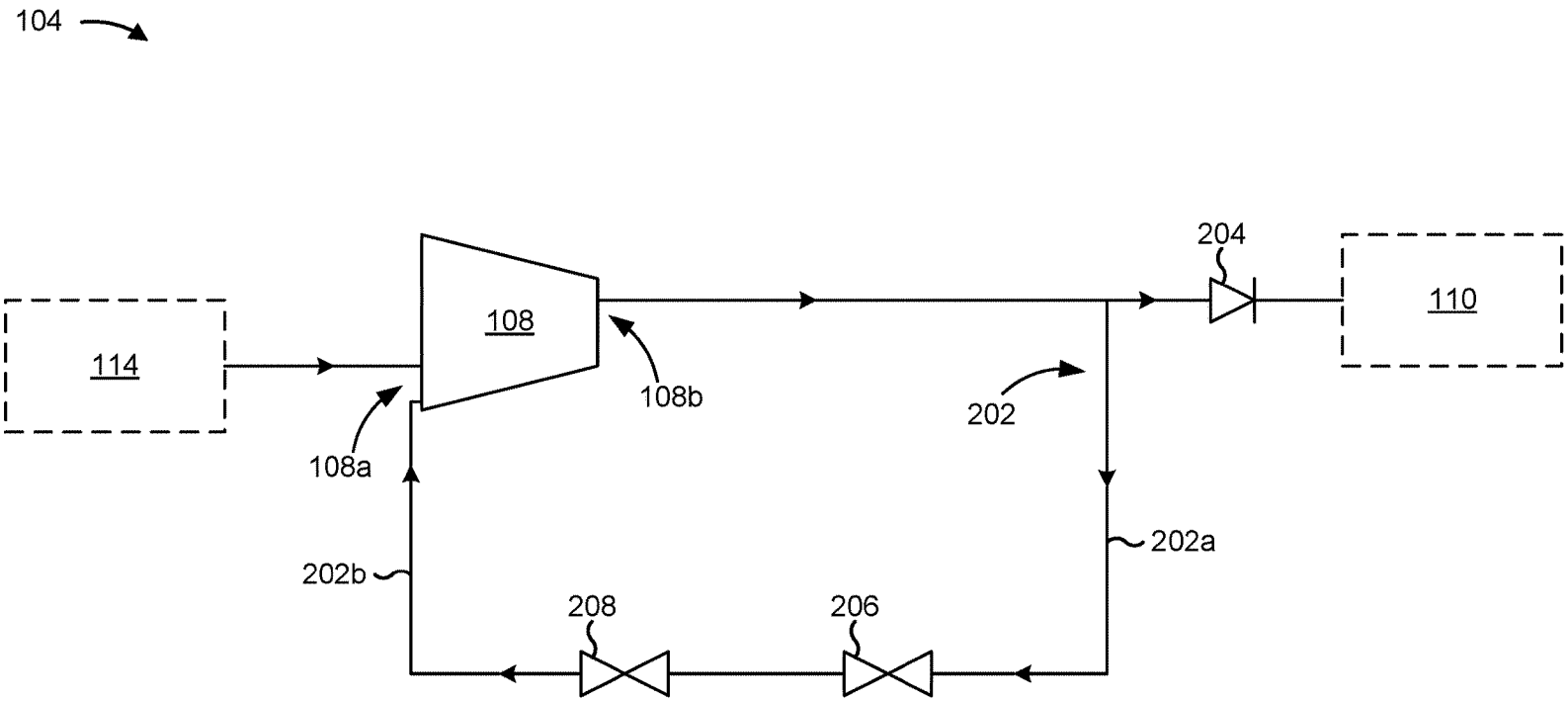
FIG. 2 is a diagram illustrating an example pump system.

FIG. 2 is a diagram illustrating an example pump system 104. As shown in FIG. 2, the pump system 104 may include a fluid pump 108, a recirculation circuit 202, a check valve 204, a control valve 206, and/or a choke valve 208. The fluid pump 108 may receive fluid (e.g., hydraulic fracturing fluid) from the blender 114. The fluid pump 108 may be configured to pressurize the fluid and discharge the pressurized fluid to the manifold 110 (e.g., via the check valve 204) and/or to the recirculation circuit 202. For example, fluid received from the blender may be at a pressure in a range from 80 to 120 psi (e.g., 100 psi), and the fluid pump 108 may pressurize the fluid up to about 12,500 psi.

The fluid pump 108 includes an inlet **108*a* (which can be referred to as a low-pressure or suction side of the fluid pump 108) and an outlet 108*b* (which can be referred to as a high-pressure or discharge side of the fluid pump 108). The inlet 108*a* may include various inlet components configured to receive fluid (e.g., low-pressure fluid) and to provide the fluid to one or more pressurization components (e.g., cylinders) of the fluid pump 108 for pressurization. For example, the inlet components may include one or more fluid conduits, one or more couplers for the fluid conduits, and/or an inlet manifold, among other examples. The inlet manifold may be configured to receive one or more fluid flows and to provide the fluid flow(s) to separate pressurization components (e.g., separate cylinders) of the fluid pump 108 for pressurization. The outlet 108*b* may include various outlet components configured to receive pressurized fluid (e.g., high-pressure fluid) from the pressurization component(s) of the fluid pump 108 and to discharge the pressurized fluid from the fluid pump 108**. For example, the outlet components may include one or more fluid conduits, one or more couplers for the fluid conduits, and/or an outlet manifold, among other examples.

The outlet components of the outlet 108*b* may have a first pressure containment capability (e.g., a pressure limit above which bursting or leaking will occur) that is greater than a second pressure containment capability of the inlet components of the inlet 108*a*. For example, a thickness of the walls of the outlet components of the outlet 108*b* may be greater than a thickness of the walls of the inlet components of the inlet 108*a*. As an example, the outlet components of the outlet 108*b* may be capable of withstanding a pressure of at least 5,000 psi, at least 10,000 psi, or at least 12,000 psi without leaking or bursting. In contrast, the inlet components of the inlet 108*a* may be capable of withstanding a pressure of at most 1,000 psi, at most 500 psi, or at most 300 psi without leaking or bursting.

The recirculation circuit 202 may include one or more fluid conduits configured to direct high-pressure fluid discharged from the fluid pump 108 to a low-pressure side of the fluid pump 108, which may reduce power consumed by a prime mover (e.g., an engine, a motor, or the like) of the fluid pump 108 and/or facilitate faster ramping up of the fluid pump 108. In particular, the recirculation circuit 202 may be configured to direct fluid from the outlet 108*b* of the fluid pump 108 to the inlet 108*a* of the fluid pump 108. For example, the outlet 108*b* of the fluid pump 108 (e.g., an outlet manifold) may include a first port for discharging fluid to the manifold 110 and a second port for discharging fluid to the recirculation circuit 202. Similarly, the inlet 108*a* of the fluid pump 108 (e.g., an inlet manifold) may include a first port for receiving fluid from the blender 114 or another supplier of fluid and a second port for receiving fluid from the recirculation circuit 202. Fluid discharged from the fluid pump 108 may enter the recirculation circuit 202 upstream of the manifold 110.

The check valve 204 may be downstream of the fluid pump 108 between the fluid pump 108 and the manifold 110. The check valve 204 may also be downstream of an entrance into the recirculation circuit 202. The check valve 204 may be configured to allow fluid flow in a forward direction from the fluid pump 108 to the manifold 110 and to prevent fluid flow in a reverse direction from the manifold 110 to the fluid pump 108 or to the recirculation circuit 202 (the prevention of fluid flow refers to an intended property of the check valve 204, and in some cases the check valve 204 may not provide absolute prevention of fluid flow due to wear or defect). The check valve 204 may include a swing check valve, a ball check valve, a piston check valve, or the like.

The control valve 206 (e.g., a ball valve) and the choke valve 208 may be in the recirculation circuit 202 between the outlet 108*b* of the fluid pump 108 and the inlet 108*a* of the fluid pump 108. The recirculation circuit 202 may be configured to direct fluid from the outlet 108*b* of the fluid pump 108, via a first portion 202*a* (referred to herein as a "discharge portion") of the recirculation circuit 202 that is upstream of the control valve 206 and the choke valve 208, to the inlet 108*a* of the fluid pump 108 via a second portion 202*b* (referred to herein as a "suction portion") of the recirculation circuit 202 that is downstream of the control valve 206 and the choke valve 208. The control valve 206 and the choke valve 208 may be between the discharge portion 202*a* of the recirculation circuit 202 and the suction portion 202*b* of the recirculation circuit 202. The control valve 206 may be upstream of the choke valve 208, as shown. Alternatively, the choke valve 208 may be upstream of the control valve 206.

As indicated above, FIG. 2 is provided as an example. Other examples may differ from what is described with regard to FIG. 2.

Figure 3:
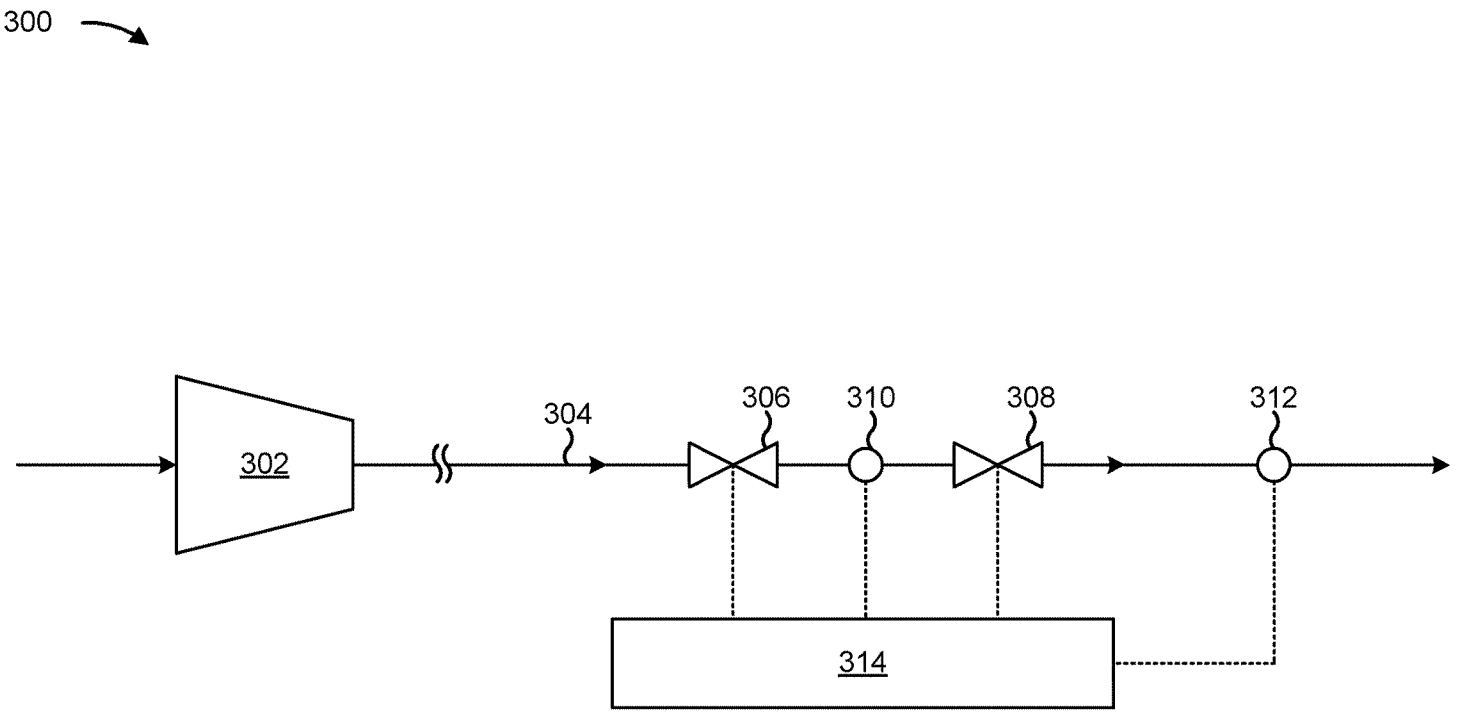
FIG. 3 is a diagram illustrating an example control system.

FIG. 3 is a diagram illustrating an example control system 300. As shown in FIG. 3, the control system 300 includes a fluid pump 302, a fluid conduit 304, a shutoff valve 306, a throttling valve 308, a first pressure sensor 310, a second pressure sensor 312, and/or a controller 314. The control system 300 may be included in a fluid system to provide flow control over fluid flowing in the fluid system. For example, the pump system 104 of the hydraulic fracturing system 100, described in connection with FIG. 2, may include the control system 300. In particular, the fluid pump 108 of the pump system 104 may correspond to the fluid pump 302, the recirculation circuit 202 of the pump system 104 may correspond to the fluid conduit 304, the control valve 206 of the pump system 104 may correspond to the shutoff valve 306, and/or the choke valve 208 of the pump system 104 may correspond to the throttling valve 308.

The fluid pump 302 may be configured to pressurize fluid and discharge the pressurized fluid through the fluid conduit 304. The fluid pump 302 may discharge fluid directly to the fluid conduit 304, or there may be one or more intervening fluid conduits and/or flow components between the fluid pump 302 and the fluid conduit 304. The fluid conduit 304 may be configured to direct fluid discharged from the fluid pump 302 (e.g., from an upstream to a downstream direction relative to the fluid pump 302).

The shutoff valve 306 (e.g., the control valve 206) may be configured for actuation between an open position and a closed position. In the open position, the shutoff valve 306 permits pressurized fluid discharged from the fluid pump 302 to flow through the fluid conduit 304 (e.g., the recirculation circuit 202). In the closed position, the shutoff valve 306 prevents pressurized fluid discharged from the fluid pump 302 from flowing through the fluid conduit 304 (the prevention of fluid flow refers to an intended property of the shutoff valve 306, and in some cases the shutoff valve 306 may not provide absolute prevention of fluid flow due to wear or defect).

The throttling valve 308 (e.g., the choke valve 208) may be configured to provide a pressure drop in the fluid conduit 304 (e.g., the recirculation circuit 202) from the discharge pressure of the fluid pump 302. The throttling valve 308 may include an orifice, and a size of the orifice may dictate an amount of fluid that can flow through the throttling valve 308. The throttling valve 308 may be in an adjustable configuration such that a size of the orifice may be varied to control a pressure of fluid in the fluid conduit 304. For example, actuation of the throttling valve 308 to a particular position may increase or decrease the size of the orifice to thereby increase or decrease, respectively, fluid flow through the throttling valve 308.

As shown in FIG. 3, the shutoff valve 306 may be upstream of the throttling valve 308. Alternatively, the throttling valve 308 may be upstream of the shutoff valve 306, as described below in connection with FIG. 4. The shutoff valve 306 and the throttling valve 308 may be communicatively connected (e.g., by wired connections or wireless connections) to the controller 314. For example, the controller 314 may provide position control commands to the shutoff valve 306 indicating whether the shutoff valve 306 is to be in the open position or the closed position. As another example, the controller 314 may provide position control commands to the throttling valve 308 indicating a position, and thus an orifice size, of the throttling valve 308.

The first pressure sensor 310 and the second pressure sensor 312 may be in the fluid conduit 304 (e.g., the recirculation circuit 202). The first pressure sensor 310 may be configured to detect a pressure of the fluid in the fluid conduit 304 at a first side of the throttling valve 308 (e.g., the choke valve 208) between the throttling valve 308 and the shutoff valve 306 (e.g., the control valve 206). For example, the first pressure sensor 310 may be located in the fluid conduit 304 at the first side of the throttling valve 308 between the throttling valve 308 and the shutoff valve 306. The second pressure sensor 312 may be configured to detect a pressure of the fluid in the fluid conduit 304 at a second side of the throttling valve 308 opposite the first side. For example, the second pressure sensor 312 may be located in the fluid conduit 304 at the second side of the throttling valve 308. The second side of the throttling valve 308 may be downstream of the shutoff valve 306 and the throttling valve 308 (e.g., in the suction portion 202*b* of the recirculation circuit 202) when the shutoff valve 306 is upstream of the throttling valve 308. Alternatively, the second side of the throttling valve 308 may be upstream of the shutoff valve 306 and the throttling valve 308 (e.g., in the discharge portion 202*a* of the recirculation circuit 202) when the throttling valve 308 is upstream of the shutoff valve 306.

The first pressure sensor 310 and the second pressure sensor 312 may be communicatively connected (e.g., by wired connections or wireless connections) to the controller 314. For example, the first pressure sensor 310 and the second pressure sensor 312 may provide pressure information to the controller 314.

The controller 314 may be configured to perform operations to assess a health of the shutoff valve 306. For example, the operations may be associated with a test for determining whether the shutoff valve 306 has a leak. A leak in the shutoff valve 306 may refer to fluid flowing through the shutoff valve 306 when the shutoff valve 306 is fully in the closed position.

The test may be initiated manually by an operator of the fluid pump 302 or autonomously by the controller 314. For example, the controller 314 may receive an input (e.g., via a user interface, a user control, or the like), from an operator of the fluid pump 302, requesting a test of the shutoff valve 306. As another example, the controller 314 may detect one or more conditions for initiating the test, and the controller 314 may autonomously initiate the test based on detecting the condition(s). For example, the controller 314 may detect that the fluid pump 302 is inactive while a power source (e.g., an engine) for the fluid pump 302 is active (e.g., an engine for the fluid pump 302 is idling while a transmission for the engine and the fluid pump 302 is in neutral), and the controller 314 may initiate the test based on detecting that the fluid pump 302 is inactive while the power source is active.

The controller 314 may perform the test while the shutoff valve 306 is closed. For example, the controller 314 may cause closing of the shutoff valve 306 prior to performing the test or in connection with performing the test. To perform the test, the controller 314 may cause actuation of the throttling valve 308 to an open position (e.g., from a closed position to an open position), which may be referred to herein as the "test position." For example, the controller 314 may cause actuation of the throttling valve 308 to a partially open position (e.g., an almost-closed position). The controller 314 may cause actuation of the throttling valve 308 to the test position responsive to the input requesting the test of the shutoff valve 306 or responsive to detecting the condition(s) for autonomous initiation of the test. The test position of the throttling valve 308 may be a set position (e.g., a predetermined position), and the controller 314 may be provisioned with information indicating the set position.

After causing actuation of the throttling valve 308 to the test position, the controller 314 may obtain first information indicating a first pressure of the fluid in the fluid conduit 304 at the first side of the throttling valve 308 between the throttling valve 308 and the shutoff valve 306. The controller 314 may also obtain second information indicating a second pressure of the fluid in the fluid conduit 304 at the second side of the throttling valve 308 opposite the first side. The controller 314 may obtain the first information from the first pressure sensor 310 and the second information from the second pressure sensor 312.

As shown in FIG. 3, the shutoff valve 306 (e.g., the control valve 206) may be upstream of the throttling valve 308 (e.g., the choke valve 208), and thus, the second pressure may be of the fluid in the fluid conduit 304 downstream of the shutoff valve 306 and the throttling valve 308 (e.g., in the suction portion 202*b* of the recirculation circuit 202). In other cases (as described in connection with FIG. 4), the throttling valve 308 (e.g., the choke valve 208) may be upstream of the shutoff valve 306 (e.g., the control valve 206), and thus, the second pressure may be of the fluid in the fluid conduit 304 upstream of the shutoff valve 306 and the throttling valve 308 (e.g., in the discharge portion 202*a* of the recirculation circuit 202).

The controller 314 may determine whether the first pressure is different from the second pressure. As used herein, the first pressure may be different from the second pressure if the first pressure and the second pressure differ by any amount, such as when the first pressure sensor 310 and the second pressure sensor 312 are perfectly calibrated to each other (e.g., the first pressure sensor 310 and the second pressure sensor 312 produce the exact same reading when measuring the same pressure) and/or have no measurement error, or differ by more than a threshold (e.g., by more than 1%), such as when the first pressure sensor 310 and the second pressure sensor 312 are not perfectly calibrated to each other and/or have measurement error. The first pressure being different from the second pressure may be indicative of a leak in the shutoff valve 306. For example, if fluid is flowing through the closed shutoff valve 306 while the throttling valve 308 is positioned to provide a pressure drop, then respective pressures on either side of the throttling valve 308 will be different due to the pressure drop. Otherwise, if there is no leak in the closed shutoff valve 306, then the first pressure and the second pressure will be in equilibrium. As used herein, the first pressure may be in equilibrium with the second pressure if the first pressure and the second pressure are exactly the same, such as when the first pressure sensor 310 and the second pressure sensor 312 are perfectly calibrated to each other and/or have no measurement error, or differ by less than a threshold (e.g., by less than 1%), such as when the first pressure sensor 310 and the second pressure sensor 312 are not perfectly calibrated to each other and/or have measurement error.

In cases in which the shutoff valve 306 (e.g., the control valve 206) is upstream of the throttling valve 308 (e.g., the choke valve 208), the first pressure may be greater than the second pressure if the shutoff valve 306 has a leak. In cases in which the throttling valve 308 (e.g., the choke valve 208) is upstream of the shutoff valve 306 (e.g., the control valve 206), the first pressure may be less than the second pressure if the shutoff valve 306 has a leak.

The controller 314 may perform one or more actions based on the first pressure being different (e.g., greater than or less than, as described herein) from the second pressure (e.g., based on a determination that the first pressure is different from the second pressure), thereby indicating a leak in the shutoff valve 306. For example, in cases in which the shutoff valve 306 (e.g., the control valve 206) is upstream of the throttling valve 308 (e.g., the choke valve 208), the controller may perform the action(s) based on the first pressure being greater than the second pressure. As another example, in cases in which the throttling valve 308 (e.g., the choke valve 208) is upstream of the shutoff valve 306 (e.g., the control valve 206), the controller may perform the action(s) based on the first pressure being less than the second pressure.

An action may include transmitting a signal to indicate that the shutoff valve 306 has a leak. For example, the signal may cause an indicator light to illuminate, may cause a notification to be displayed in a user interface, may cause an alarm to activate, or the like. Additionally, or alternatively, an action may include transmitting a maintenance request for the shutoff valve 306, generating a calendar entry scheduling maintenance for the shutoff valve 306, and/or performing a transaction for purchasing a new shutoff valve 306. Additionally, or alternatively, an action may include causing deactivation of the fluid pump 302, to prevent fluid flow through the fluid conduit 304. In this way, the controller 314 may monitor the health of the shutoff valve 306 to identify faults and perform remedial actions to reduce a likelihood of a catastrophic failure of the shutoff valve 306.

In some implementations, the controller 314 may verify that the pressure sensors 310, 312 are functioning properly and/or are calibrated to each other prior to performing the test. Here, while the shutoff valve 306 is closed, the controller 314 may cause actuation of the throttling valve 308 to a fully open position (e.g., a more open position than the test position). After actuation of the throttling valve 308, the controller 314 may determine whether the first pressure at the first side of the throttling valve 308 and the second pressure at the second side of the throttling valve 308 are in equilibrium, in a similar manner as described above. The first pressure and the second pressure being in equilibrium may indicate that the pressure sensors 310, 312 are functioning properly and/or are calibrated to each other. Accordingly, the controller 314 may initiate the test by causing actuation of the throttling valve 308 to the test position, as described herein, based on the first pressure and the second pressure being in equilibrium when the throttling valve is in the fully open position.

As indicated above, FIG. 3 is provided as an example. Other examples may differ from what is described with regard to FIG. 3.

Figure 4:
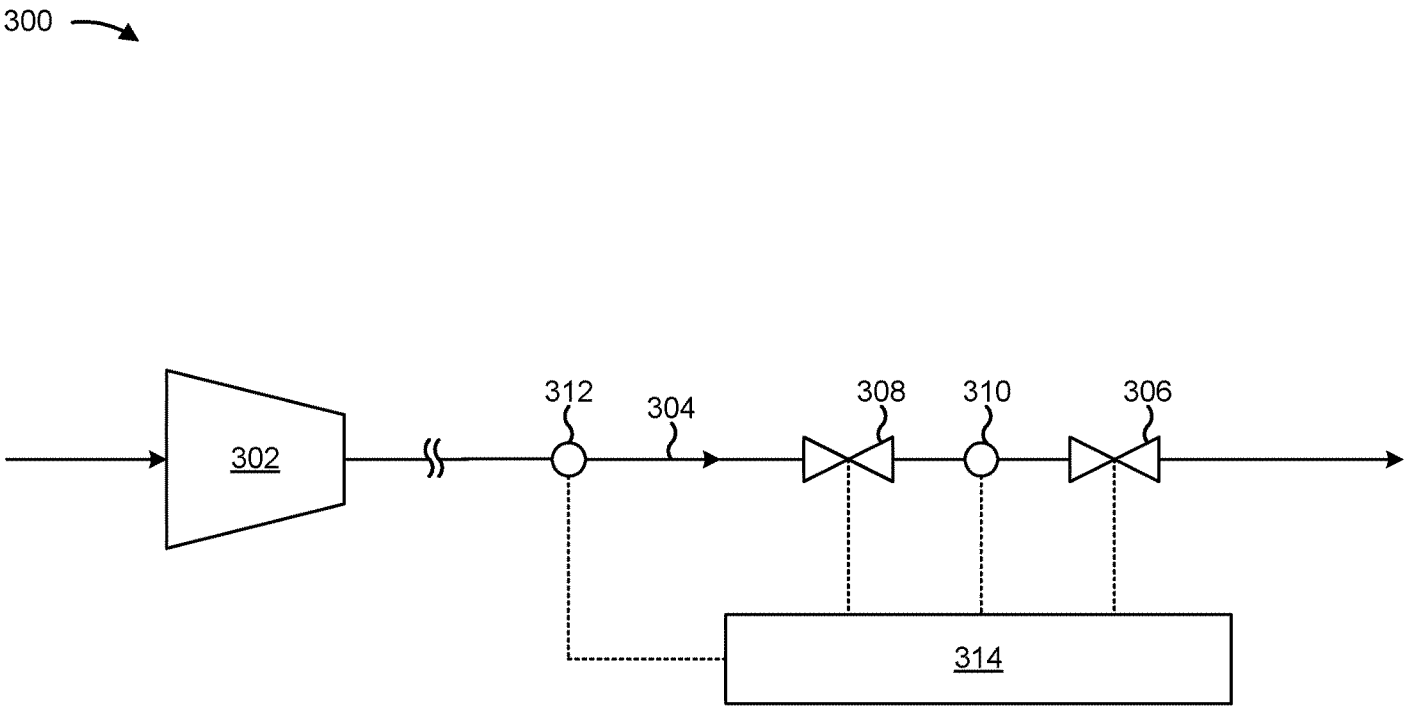
FIG. 4 is a diagram illustrating an alternative example of the control system of FIG. 3.

FIG. 4 is a diagram illustrating an alternative example of the control system 300. As shown in FIG. 4, the throttling valve 308 may be upstream of the shutoff valve 306. Thus, the second pressure sensor 312 may be upstream of the shutoff valve 306 and the throttling valve 308. In this configuration, the first pressure being less than the second pressure may be indicative of a leak in the shutoff valve 306, as described herein.

As indicated above, FIG. 4 is provided as an example. Other examples may differ from what is described with regard to FIG. 4.

Figure 5:
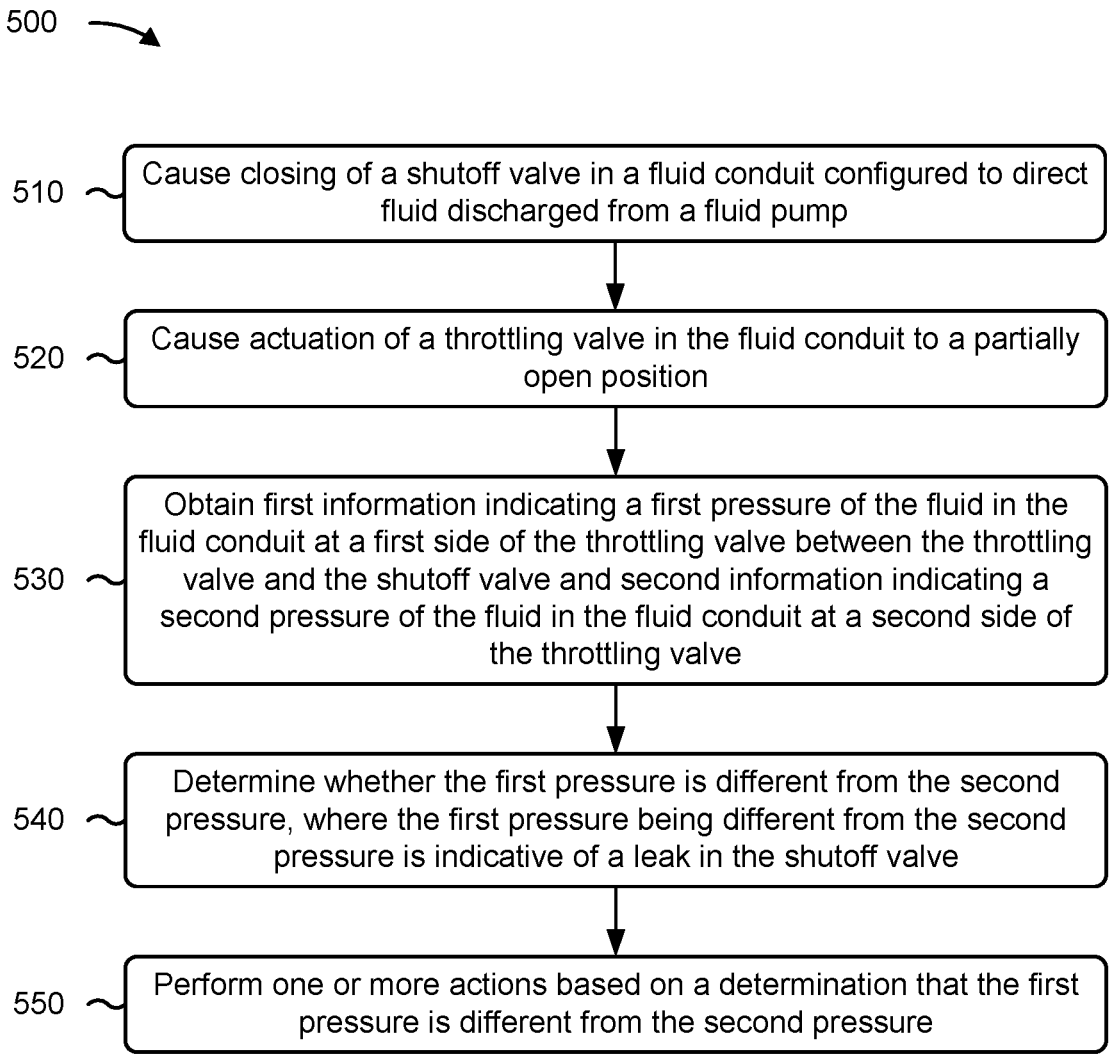
FIG. 5 is a flowchart of an example process associated with monitoring a health of a valve.

FIG. 5 is a flowchart of an example process 500 associated with monitoring a health of a valve. One or more process blocks of FIG. 5 may be performed by a controller (e.g., controller 314). Additionally, or alternatively, one or more process blocks of FIG. 5 may be performed by another device or a group of devices separate from or including the controller, such as another device or component that is internal or external to the hydraulic fracturing system 100 or another fluid system. Additionally, or alternatively, one or more process blocks of FIG. 5 may be performed by one or more components of a device, such as a processor, a memory, an input component, an output component, and/or a communication component.

As shown in FIG. 5, process 500 may include causing closing of a shutoff valve in a fluid conduit configured to direct fluid discharged from a fluid pump (block 510). For example, the controller may cause closing of a shutoff valve in a fluid conduit configured to direct fluid discharged from a fluid pump, as described above.

As further shown in FIG. 5, process 500 may include causing actuation of a throttling valve in the fluid conduit to a partially open position (block 520). For example, the controller may cause actuation of a throttling valve in the fluid conduit to a partially open position, as described above. Process 500 may include receiving an input requesting a test of the control valve, and causing actuation of the choke valve may be responsive to the input. Process 500 may include causing actuation of the throttling valve to a fully open position, and determining that the first pressure and the second pressure are in equilibrium. Causing actuation of the throttling valve to the partially open position may be based on the first pressure and the second pressure being in equilibrium when the throttling valve is in the fully open position.

As further shown in FIG. 5, process 500 may include obtaining first information indicating a first pressure of the fluid in the fluid conduit at a first side of the throttling valve between the throttling valve and the shutoff valve and second information indicating a second pressure of the fluid in the fluid conduit at a second side of the throttling valve (block 530). For example, the controller may obtain first information indicating a first pressure of the fluid in the fluid conduit at a first side of the throttling valve between the throttling valve and the shutoff valve and second information indicating a second pressure of the fluid in the fluid conduit at a second side of the throttling valve, as described above. The first information may be obtained from a first pressure sensor configured to detect the first pressure and the second information may be obtained from a second pressure sensor configured to detect the second pressure.

As further shown in FIG. 5, process 500 may include determining whether the first pressure is different from the second pressure, where the first pressure being different from the second pressure is indicative of a leak in the shutoff valve (block 540). For example, the controller may determine whether the first pressure is different from the second pressure, as described above.

As further shown in FIG. 5, process 500 may include performing one or more actions based on a determination that the first pressure is different from the second pressure (block 550). For example, the controller may perform one or more actions based on a determination that the first pressure is different from the second pressure, as described above. Performing the one or more actions may include transmitting a signal to indicate that the shutoff valve has the leak.

The shutoff valve may be upstream of the throttling valve, the second pressure may be of the fluid downstream of the shutoff valve and the throttling valve, and the one or more actions may be performed based on the first pressure being greater than the second pressure. Alternatively, the throttling valve may be upstream of the shutoff valve, the second pressure may be of the fluid upstream of the shutoff valve and the throttling valve, and the one or more actions may be performed based on the first pressure being less than the second pressure.

Although FIG. 5 shows example blocks of process 500, in some implementations, process 500 may include additional blocks, fewer blocks, different blocks, or differently arranged blocks than those depicted in FIG. 5. Additionally, or alternatively, two or more of the blocks of process 500 may be performed in parallel.

INDUSTRIAL APPLICABILITY

The control system described herein may be used with any fluid system that provides flow control of a fluid. For example, the control system may be used with a fluid system that utilizes a shutoff valve and a throttling valve to provide flow control of a fluid. In some examples, the control system may be used with a hydraulic fracturing system that pressurizes hydraulic fracturing fluid using a fluid pump that utilizes a recirculation circuit controlled by a control valve and a choke valve.

The control system is useful for monitoring a health of the shutoff valve (e.g., the control valve). In particular, the control system may determine whether the shutoff valve has a leak, and the control system may perform a remedial action if it is determined that the shutoff valve has a leak. Accordingly, the control system may prevent damage to the shutoff valve and/or downstream equipment in the fluid system as well as improve a useful life of the shutoff valve and the downstream equipment.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A control system, comprising:

a recirculation circuit configured to direct fluid from an outlet of a fluid pump of a hydraulic fracturing system, via a first portion of the recirculation circuit, to an inlet of the fluid pump via a second portion of the recirculation circuit;

a control valve in the recirculation circuit between the first portion of the recirculation circuit and the second portion of the recirculation circuit;

a choke valve in the recirculation circuit between the first portion of the recirculation circuit and the second portion of the recirculation circuit; and a controller configured to:

cause, while the control valve is closed, actuation of the choke valve to a partially open position;

obtain, from a first pressure sensor associated with the recirculation circuit, first information indicating a first pressure of the fluid at a first side of the choke valve between the choke valve and the control valve and, from a second pressure sensor associated with the recirculation circuit, second information indicating a second pressure of the fluid at a second side of the choke valve; and transmit a signal to indicate that the control valve has a leak based on the first pressure being different from the second pressure.

2. The control system of claim 1, wherein the controller is further configured to:

cause actuation of the choke valve to a fully open position, wherein the controller is configured to cause actuation of the choke valve to the partially open position based on the first pressure and the second pressure being in equilibrium when the choke valve is in the fully open position.

3. The control system of claim 1, wherein the control valve is upstream of the choke valve, and wherein the second pressure is of the fluid in the second portion of the recirculation circuit.

4. The control system of claim 3, wherein the controller is configured to transmit the signal based on the first pressure being greater than the second pressure.

5. The control system of claim 1, wherein the choke valve is upstream of the control valve, and wherein the second pressure is of the fluid in the first portion of the recirculation circuit.

6. The control system of claim 5, wherein the controller is configured to transmit the signal based on the first pressure being less than the second pressure.

7. The control system of claim 1, wherein the controller is further configured to:

receive an input requesting a test of the control valve, wherein the controller is configured to cause actuation of the choke valve responsive to the input.

8. A control system, comprising:

a fluid conduit configured to direct fluid discharged from a fluid pump;

a shutoff valve in the fluid conduit;

a throttling valve in the fluid conduit; and a controller configured to:

cause, while the shutoff valve is closed, actuation of the throttling valve to an open position;

obtain first information indicating a first pressure of the fluid in the fluid conduit at a first side of the throttling valve between the throttling valve and the shutoff valve and second information indicating a second pressure of the fluid in the fluid conduit at a second side of the throttling valve; and transmit a signal to indicate that the shutoff valve has a leak based on the first pressure being different from the second pressure.

9. The control system of claim 8, wherein the open position is a partially open position.

10. The control system of claim 8, wherein the shutoff valve is upstream of the throttling valve, and wherein the second pressure is of the fluid downstream of the shutoff valve and the throttling valve.

11. The control system of claim 10, wherein the controller is configured to transmit the signal based on the first pressure being greater than the second pressure.

12. The control system of claim 8, wherein the throttling valve is upstream of the shutoff valve, and wherein the second pressure is of the fluid upstream of the shutoff valve and the throttling valve.

13. The control system of claim 12, wherein the controller is configured to transmit the signal based on the first pressure being less than the second pressure.

14. The control system of claim 8, wherein the fluid conduit is a recirculation circuit configured to direct the fluid from an outlet of the fluid pump to an inlet of the fluid pump.

15. The control system of claim 8, further comprising:

a first pressure sensor configured to detect the first pressure; and a second pressure sensor configured to detect the second pressure, wherein the controller is configured to obtain the first information from the first pressure sensor and the second information from the second pressure sensor.

16. A method, comprising:

causing, by a controller, closing of a shutoff valve in a fluid conduit configured to direct fluid discharged from a fluid pump;

causing, by the controller, actuation of a throttling valve in the fluid conduit to a partially open position;

obtaining, by the controller via communication with respective first and second pressure sensors associated with the fluid conduit, first information indicating a first pressure of the fluid in the fluid conduit at a first side of the throttling valve between the throttling valve and the shutoff valve and second information indicating a second pressure of the fluid in the fluid conduit at a second side of the throttling valve;

determining, by the controller, whether the first pressure is different from the second pressure, wherein the first pressure being different from the second pressure is indicative of a leak in the shutoff valve; and performing one or more actions based on a determination that the first pressure is different from the second pressure.

17. The method of claim 16, wherein performing the one or more actions comprises:

transmitting a signal to indicate that the shutoff valve has the leak.

18. The method of claim 16, further comprising:

causing actuation of the throttling valve to a fully open position; and determining that the first pressure and the second pressure are in equilibrium, wherein the controller is configured to cause actuation of the throttling valve to the partially open position based on the first pressure and the second pressure being in equilibrium when the throttling valve is in the fully open position.

19. The method of claim 16, wherein the shutoff valve is upstream of the throttling valve, wherein the second pressure is of the fluid downstream of the shutoff valve and the throttling valve, and wherein the one or more actions are performed based on the first pressure being greater than the second pressure.

20. The method of claim 16, wherein the throttling valve is upstream of the shutoff valve, wherein the second pressure is of the fluid upstream of the shutoff valve and the throttling valve, and wherein the one or more actions are performed based on the first pressure being less than the second pressure.

* * * * *